US008063871B2

(12) United States Patent
Lee et al.

(10) Patent No.: US 8,063,871 B2
(45) Date of Patent: Nov. 22, 2011

(54) LOW-POWER DRIVING APPARATUS AND METHOD

(75) Inventors: Seung-sin Lee, Yongin-si (KR); Du-sik Park, Suwon-si (KR); In-ji Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 983 days.

(21) Appl. No.: 11/939,210

(22) Filed: Nov. 13, 2007

(65) Prior Publication Data

US 2008/0186393 A1 Aug. 7, 2008

(30) Foreign Application Priority Data

Feb. 7, 2007 (KR) ..... 10-2007-0012852

(51) Int. Cl.
*G09G 3/36* (2006.01)

(52) U.S. Cl. ..... 345/102; 345/87; 345/204; 345/211; 345/212

(58) Field of Classification Search ..... 345/55, 345/84, 87, 102, 104, 204, 211, 212
See application file for complete search history.

(56) References Cited

U.S. PATENT DOCUMENTS

| | | | | |
|---|---|---|---|---|
| 6,069,449 | A * | 5/2000 | Murakami | 315/158 |
| 6,144,359 | A * | 11/2000 | Grave | 345/207 |
| 6,300,931 | B1 * | 10/2001 | Someya et al. | 345/102 |
| 6,388,388 | B1 * | 5/2002 | Weindorf et al. | 315/169.3 |
| 6,411,306 | B1 * | 6/2002 | Miller et al. | 345/102 |
| 6,762,741 | B2 * | 7/2004 | Weindorf | 345/102 |
| 7,129,938 | B2 * | 10/2006 | Naugler, Jr. | 345/207 |
| 7,768,496 | B2 * | 8/2010 | Daly | 345/102 |
| 7,825,891 | B2 * | 11/2010 | Yao et al. | 345/102 |
| 2004/0155853 | A1 | 8/2004 | Lin | |
| 2005/0134547 | A1 * | 6/2005 | Wyatt | 345/102 |
| 2005/0151716 | A1 | 7/2005 | Lin | |
| 2005/0219394 | A1 | 10/2005 | Du et al. | |
| 2006/0132424 | A1 * | 6/2006 | Foo et al. | 345/102 |
| 2008/0055231 | A1 * | 3/2008 | Nose et al. | 345/102 |

FOREIGN PATENT DOCUMENTS

| | | |
|---|---|---|
| CN | 1680999 A | 10/2005 |
| JP | 11-67464 | 3/1999 |
| KR | 2004-33545 | 4/2004 |
| KR | 2005-25579 | 3/2005 |
| KR | 2006-25741 | 3/2006 |
| KR | 2006-103527 | 10/2006 |

OTHER PUBLICATIONS

Office Action issued Feb. 21, 2008 by the Korean Intellectual Property Office for Korean Patent Application No. 2007-12852.

(Continued)

*Primary Examiner* — My-Chau T Tran
(74) *Attorney, Agent, or Firm* — Staas & Halsey LLP

(57) ABSTRACT

A low-power driving apparatus and method are provided. The low-power driving apparatus includes an illuminance-sensing module to sense illuminance, a minimum-perceivable-brightness-determination module to determine a minimum perceivable brightness having non-linear characteristics corresponding to the sensed illuminance, a driving-power-level-determination module to determine a power level based on the determined minimum perceivable brightness, and a driving module to display an image input according to the determined driving power level.

20 Claims, 11 Drawing Sheets

OTHER PUBLICATIONS

P. Haubner et al., "A Unified Relationship between Brightness and Luminance", Proceedings of the 19th Session of the International Commission on Illumination (CIE), Kyoto, Japan, 1979, pp. 99-102, republished in *Siemens Forschungs- und Entwicklungsberichte*, vol. 9, No. 6, 1980, pp. 315-318.

Extended European Search Report, mailed Sep. 30, 2009, in corresponding European Application No. 08150969.7 (8 pp.).

Chinese Office Action, with English Translation, issued in corresponding Chinese Patent Application No. 200810008699.0, dated on Jun. 16, 2011.

* cited by examiner

FIG. 10

1000

| | | | | | | | | | | | | | | |
|---|---|---|---|---|---|---|---|---|---|---|---|---|---|---|
| 4 | 4 | 4 | 4 | 3 | 3 | 3 | 3 | 3 | 3 | 3 | 4 | 4 | 4 | 4 |
| 4 | 4 | 4 | 3 | 3 | 3 | 3 | 3 | 3 | 3 | 3 | 3 | 4 | 4 | 4 |
| 4 | 4 | 4 | 3 | 3 | 3 | 2 | 2 | 2 | 3 | 3 | 3 | 4 | 4 | 4 |
| 4 | 4 | 3 | 3 | 3 | 2 | 2 | 2 | 2 | 2 | 3 | 3 | 3 | 4 | 4 |
| 4 | 4 | 3 | 3 | 2 | 2 | 2 | 1 | 2 | 2 | 2 | 3 | 3 | 4 | 4 |
| 4 | 4 | 3 | 3 | 2 | 2 | 1 | 1 | 1 | 2 | 2 | 3 | 3 | 4 | 4 |
| 4 | 4 | 3 | 3 | 2 | 1 | 1 | 1 | 1 | 1 | 2 | 3 | 3 | 4 | 4 |
| 4 | 4 | 3 | 2 | 2 | 1 | 1 | 0 | 1 | 1 | 2 | 2 | 3 | 4 | 4 |
| 4 | 3 | 3 | 2 | 2 | 1 | 0 | 0 | 0 | 1 | 2 | 2 | 3 | 3 | 4 |
| 4 | 3 | 3 | 2 | 2 | 1 | 0 | 0 | 0 | 1 | 2 | 2 | 3 | 3 | 4 |
| 4 | 3 | 3 | 2 | 2 | 1 | 0 | 0 | 0 | 1 | 2 | 2 | 3 | 3 | 4 |
| 4 | 3 | 3 | 2 | 2 | 1 | 0 | 0 | 0 | 1 | 2 | 2 | 3 | 3 | 4 |
| 4 | 4 | 3 | 2 | 2 | 1 | 1 | 0 | 1 | 1 | 2 | 2 | 3 | 4 | 4 |
| 4 | 4 | 3 | 3 | 2 | 1 | 1 | 1 | 1 | 1 | 2 | 3 | 3 | 4 | 4 |
| 4 | 4 | 3 | 3 | 2 | 2 | 1 | 1 | 1 | 2 | 2 | 3 | 3 | 4 | 4 |
| 4 | 4 | 3 | 3 | 2 | 2 | 2 | 1 | 2 | 2 | 2 | 3 | 3 | 4 | 4 |
| 4 | 4 | 3 | 3 | 3 | 2 | 2 | 2 | 2 | 2 | 3 | 3 | 3 | 4 | 4 |
| 4 | 4 | 4 | 3 | 3 | 3 | 2 | 2 | 2 | 3 | 3 | 3 | 4 | 4 | 4 |
| 4 | 4 | 4 | 3 | 3 | 3 | 3 | 3 | 3 | 3 | 3 | 3 | 4 | 4 | 4 |
| 4 | 4 | 4 | 4 | 3 | 3 | 3 | 3 | 3 | 3 | 3 | 4 | 4 | 4 | 4 |

LOW-POWER DRIVING APPARATUS AND METHOD

CROSS-REFERENCE TO RELATED APPLICATIONS

This application claims the benefit of Korean Patent Application No. 2007-12852 filed on Feb. 7, 2007, in the Korean Intellectual Property Office, the disclosure of which is incorporated herein by reference in its entirety.

BACKGROUND OF THE INVENTION

1. Field of the Invention

Aspects of the invention relate to a low-power driving apparatus and method, and more particularly to a low-power driving apparatus and method that can reduce driving power by dynamically controlling brightness of a display monitor based on ambient conditions.

2. Description of the Related Art

Personal portable terminals such as mobile phones or PDAs offer unprecedented user convenience due to advantageous features, including portability, mobility, and the like. In this regard, however, it is necessary to minimize power consumed by the personal portable terminals due to such features.

For example, among various components forming a personal portable terminal, a component for supplying a light source to display an image, e.g., backlight unit, consumes the majority of power consumed in the personal portable terminal. In such a case, by reducing the power consumed by the backlight unit and a luminance reduction rate due to the reduced power consumption is compensated for by digitally processing image information, thereby achieving a low-driving power effect of the personal portable terminal while maintaining the overall luminance of the image perceived by the user.

Meanwhile, personal portable terminals are exposed to various conditions due to such characteristics, by which a user may differently perceive brightness of an image appearing on a display monitor depending on ambient illuminance even if light having a constant magnitude is continuously supplied from a backlight unit, that is, the luminance of the display monitor is uniform. Consequently, visual perception of the image may deteriorate and power consumption may be caused due to unnecessarily high luminance.

Accordingly, there is a need for a personal portable terminal capable of achieving a low-power driving effect while maintaining the brightness of an image at a minimum level even when the ambient illuminance is changed.

SUMMARY OF THE INVENTION

Aspects of the invention relate to low-power driving that can reduce driving power in a restricted power supply condition of a mobile device by dynamically controlling brightness of a display monitor based on the ambient condition.

Aspects of the invention also relate to low-power driving that can reduce driving power in a restricted power supply condition of a mobile device by dynamically controlling brightness of a display monitor based on the image content as well as the ambient condition.

According to an aspect of the invention, a low-power driving apparatus includes an illuminance-sensing module to sense illuminance, a minimum-perceivable-brightness-determination module to determine a minimum perceivable brightness having non-linear characteristics corresponding to the sensed illuminance, a driving-power-level-determination module to determine a power level based on the determined minimum perceivable brightness, and a driving module to display an image input according to the determined driving power level.

According to an aspect of the invention, a low-power driving method includes sensing illuminance, determining a minimum perceivable brightness having non-linear characteristics corresponding to the sensed illuminance, determining a power level based on the determined minimum perceivable brightness, and displaying an image input according to the determined driving-power level.

Additional aspects and/or advantages of the invention will be set forth in part in the description that follows and, in part, will be obvious from the description, or may be learned by practice of the invention.

BRIEF DESCRIPTION OF THE DRAWINGS

The above and/or other aspects and advantages of the invention will become apparent and more readily appreciated from the following description of embodiments of the invention, taken in conjunction with the accompanying drawings of which:

FIG. 10 shows variable gain values allocated to the respective pixels constituting an input image according to an aspect of the invention.

DETAILED DESCRIPTION OF THE EMBODIMENTS

Figure 1:
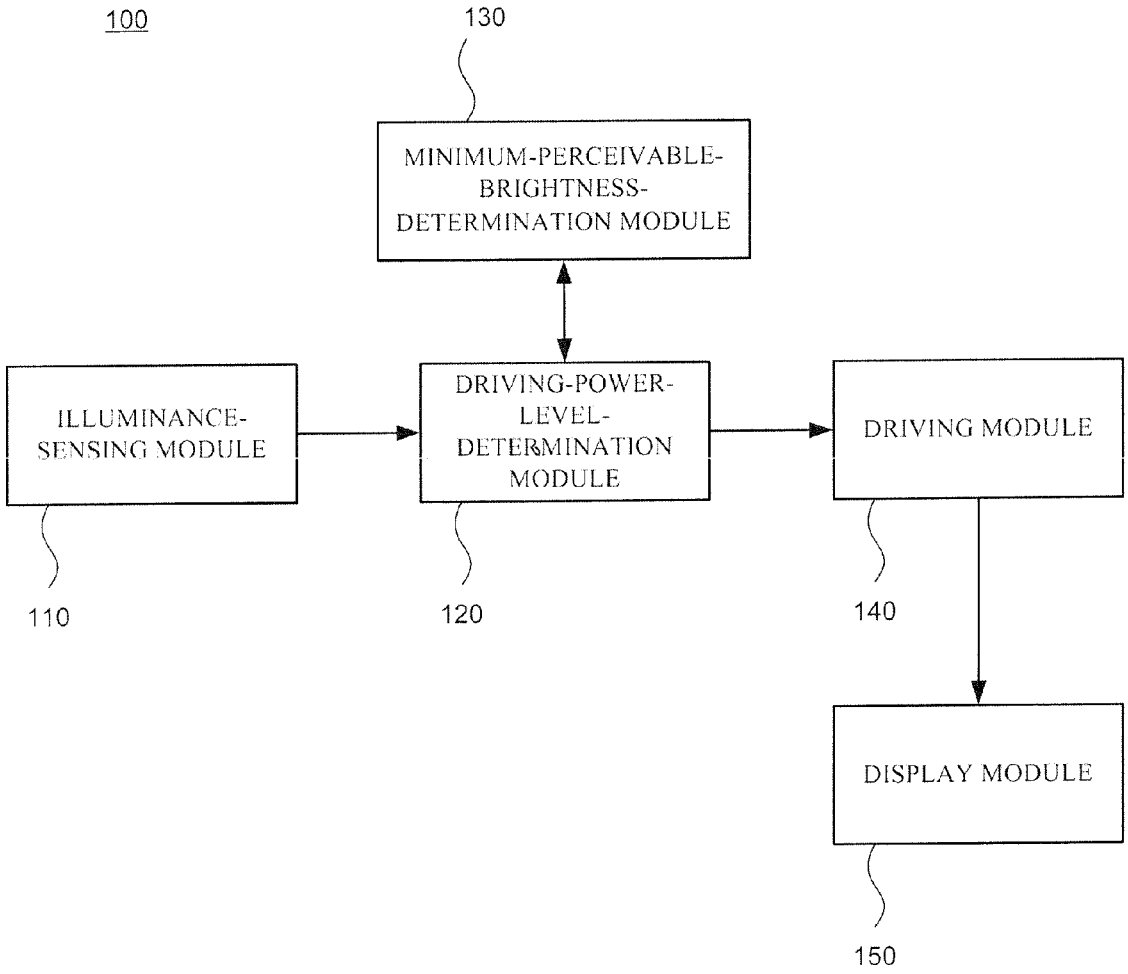
FIG. 1 is a block diagram of a low-power driving apparatus according to an aspect of the invention.

Reference will now be made to embodiments of the invention, examples of which are shown in the accompanying drawings, wherein like reference numerals refer to like elements throughout. The embodiments are described below in order to explain the invention by referring to the figures.

The invention is described hereinafter with reference to flowchart illustrations of methods according to aspects of the invention. It will be understood that each block of the flowchart illustrations, and combinations of blocks in the flowchart illustrations, can be implemented by computer program instructions. These computer program instructions can be provided to a processor of a general purpose computer, special purpose computer, or other programmable data processing apparatus to create means for implementing the functions specified in the flowchart block or blocks.

These computer program instructions may also be stored in a computer usable or computer-readable memory that can direct a computer or other programmable data processing apparatus to function in a particular manner, such that the instructions implement the function specified in the flowchart block or blocks.

The computer program instructions may also be loaded into a computer or other programmable data processing apparatus to cause a series of operations to be performed on the computer or other programmable apparatus to produce a computer implemented process for implementing the functions specified in the flowchart block or blocks.

In addition, each block may represent a module, a segment, or a portion of code, which may comprise one or more executable instructions for implementing the specified logical functions. It should also be noted that in other implementations, the functions noted in the blocks may occur out of the order noted or in different configurations of hardware and software. For example, two blocks shown in succession may, in fact, be executed substantially concurrently, or the blocks may sometimes be executed in reverse order, depending on the functionality involved.

FIG. 1 is a block diagram of a low-power driving apparatus according to an aspect of the invention.

Referring to FIG. 1, the low-power driving apparatus 100, e.g., a portable mobile device, includes an illuminance-sensing module 110, a driving-power-level-determination module 120, a minimum-perceivable-brightness-determination module 130, a driving module 140, and a display module 150.

The illuminance-sensing module 110 senses illuminance of a location at which the low-power driving apparatus 100 is positioned. To this end, the illuminance-sensing module 110 may comprise a light sensor such as a photodiode, a phototransistor, or a photo-conductor.

The driving-power-level-determination module 120 determines a driving power level based on minimum perceivable brightness determined by the sensed illuminance. The driving power level may be an intensity of a light source for displaying an image.

Based on the sensed illuminance, the minimum-perceivable-brightness-determination module 130 determines a minimum brightness perceived by a user under a condition in which the low-power driving apparatus 100 is currently placed. Then, the determined minimum perceivable brightness is provided to the driving-power-level-determination module 120 to control the driving power.

The driving module 140 supplies a light source for displaying an image according to the driving power level determined by the driving-power-level-determination module 120. The driving module 140 may be a component for providing the light source for displaying an image, e.g., a backlight unit.

The display module 150 displays an image using the light source supplied from the driving module 140.

Figure 2:
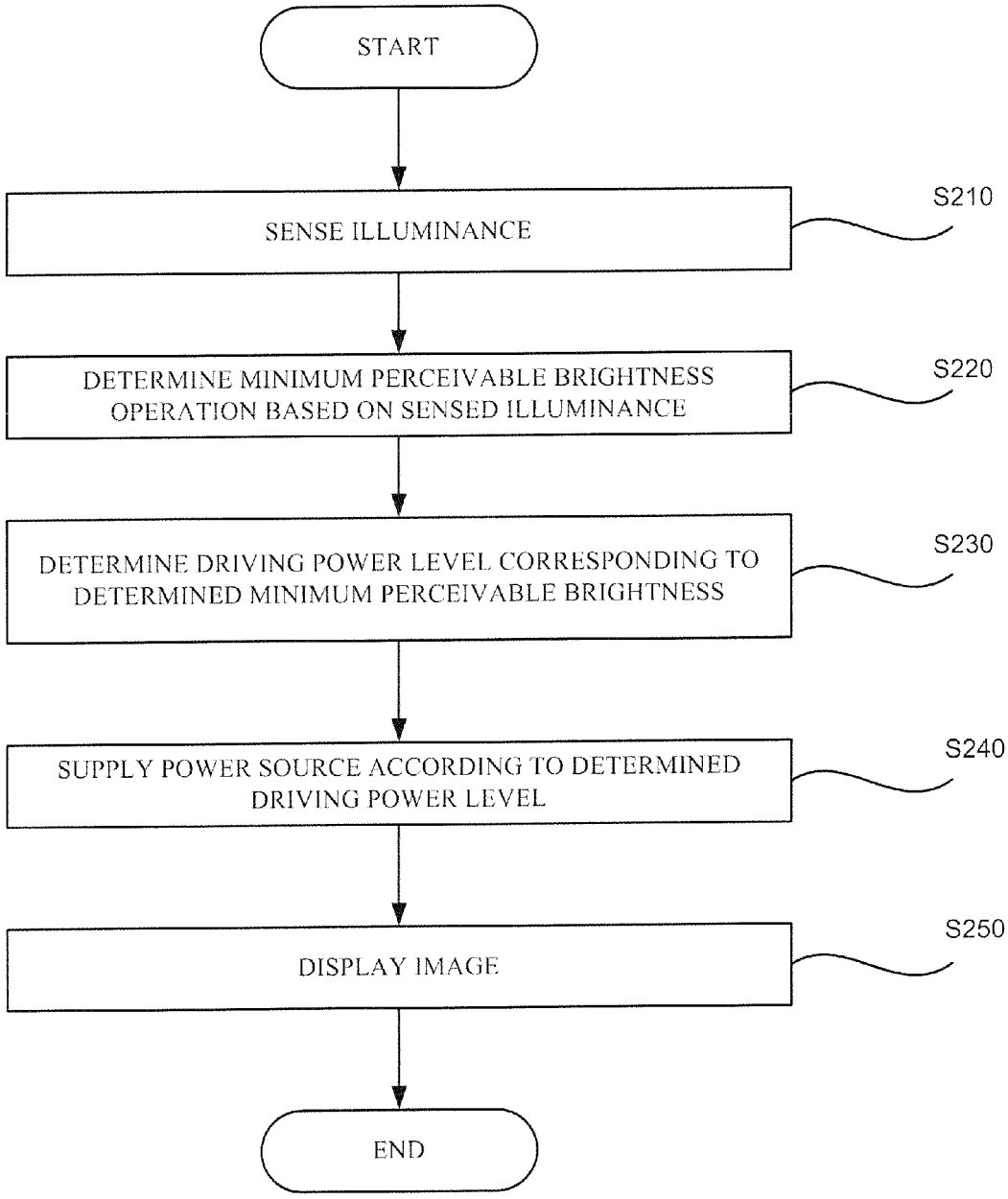
FIG. 2 is a flow chart illustrating a low-power driving method according to an aspect of the invention.

Operations among various modules shown in FIG. 1 will now be described in detail with reference to FIG. 2.

First, in operation S210, the illuminance-sensing module 110 senses illuminance of a location at which the low-power driving apparatus 100 is positioned, and the sensed illuminance information is then supplied to the driving-power-level-determination module 120.

In operation S220, the driving-power-level-determination module 120 supplies the illuminance information to the minimum-perceivable-brightness-determination module 130, and the minimum-perceivable-brightness-determination module 130 determines a minimum perceivable brightness using the supplied illuminance information. While FIG. 1 shows that the minimum-perceivable-brightness-determination module 130 receives the illuminance information from the driving-power-level-determination module 120, the invention is not limited to the illustrated example, and the minimum-perceivable-brightness-determination module 130 may receive the illuminance information directly from the illuminance-sensing module 110.

The minimum-perceivable-brightness-determination module 130 determines a minimum perceivable brightness as follows.

The invention is based on the concept that brightness of a display monitor can be adaptively controlled according to ambient illuminance depending on human visual characteristics.

According to research into the human visual brightness perception, as taught in, for example, H.-W. Bodmann, P. Haubner, and A. M. Marsden, "A Unified Relationship between Brightness and Luminance," Proceedings of the 19th Session of the International Commission on Illumination (CIE), Kyoto, Japan, 1979, pp. 99-102, republished in Siemens Forschungs-und Entwicklungsberichte, Vol. 9, No. 6, 1980, p. 315-318, the image brightness perceived by a human, that is, the perceived brightness, can roughly be expressed as an exponential function of driving power of the image luminance. In particular, as expressed in Equation 1, it was found that the perceived brightness could be modeled as a function associated with ambient illuminance as well as the image luminance:

$$B=C_T(\phi)L_T^n-S_1(\phi)L_u^n-C_T(\phi)S_0(\phi) \tag{1}$$

In Equation (1), n=0.31±0.03, $\phi$ is a visual angle, $C_T(\phi)$, $S_1(\phi)$, and $S_0(\phi)$ are constants determined by the visual angle. Here, the brightness B is an arbitrarily set value on an assumption that the brightness is set to 100 when $L_T=L_u=300$ cd/m$^2$.

When the exponent of the image brightness perceived by the user is fixed, the function of the image brightness depending on the ambient illuminance can be obtained using Equation (1). It can be derived that the same image brightness level is perceived at a given image luminance level with a given ambient illuminance level in Equation (1).

In Equation (1), assuming that $L_T$, denotes luminance of a light source provided by the driving module 140, and $L_u$ denotes ambient luminance, the relationship between $L_T$ and $L_u$ for maintaining brightness scales perceived at the same level can be obtained using Equation (2) by setting B as a constant:

$$L_T=\left(\frac{S_1(\phi)}{C_T(\phi)}L_u^n+S_o(\phi)+\frac{B}{C_T(\phi)}\right)^{\frac{1}{n}} \tag{2}$$

In Equation (2), the image brightness scales characteristics of the display monitor and the user's allowable limit, i.e., a degree of brightness that can be perceived by a user, are not taken into consideration. In practice, when users are allowed to choose an option of the highest permissible minimum brightness on a display monitor like LCD or OLED, different results from those from the modeling described above are obtained due to human visual adaptation characteristics depending on the illuminance and the effect of external light exerted on the display monitor.

In other words, under a dark room condition, users showed satisfying perception levels even on a screen darker than the proposed model and the minimum perceivable brightness increased as the illuminance became higher. Using these users' perception characteristics, the invention proposes a model for maintaining the minimum perceivable brightness as expressed in Equation (3):

$$L_T = (C_1 E_u^n + C_2)^{\frac{1}{n}} \quad (3)$$

Where $E_u$ denotes ambient illuminance, and $L_T$ denotes luminance of a display monitor satisfying the minimum perceivable brightness, i.e., luminance supplied by the driving module 140. In addition, $C_1$ and $C_2$ can be determined by user experiments under dark and bright room conditions. For example, $C_1$*EQUATION* and $C_2$*EQUATION* can be determined by allowing a user to adjust the luminance of a display monitor in a dark room condition and a bright office condition (e.g., about 1,000 lux).

Figure 3:
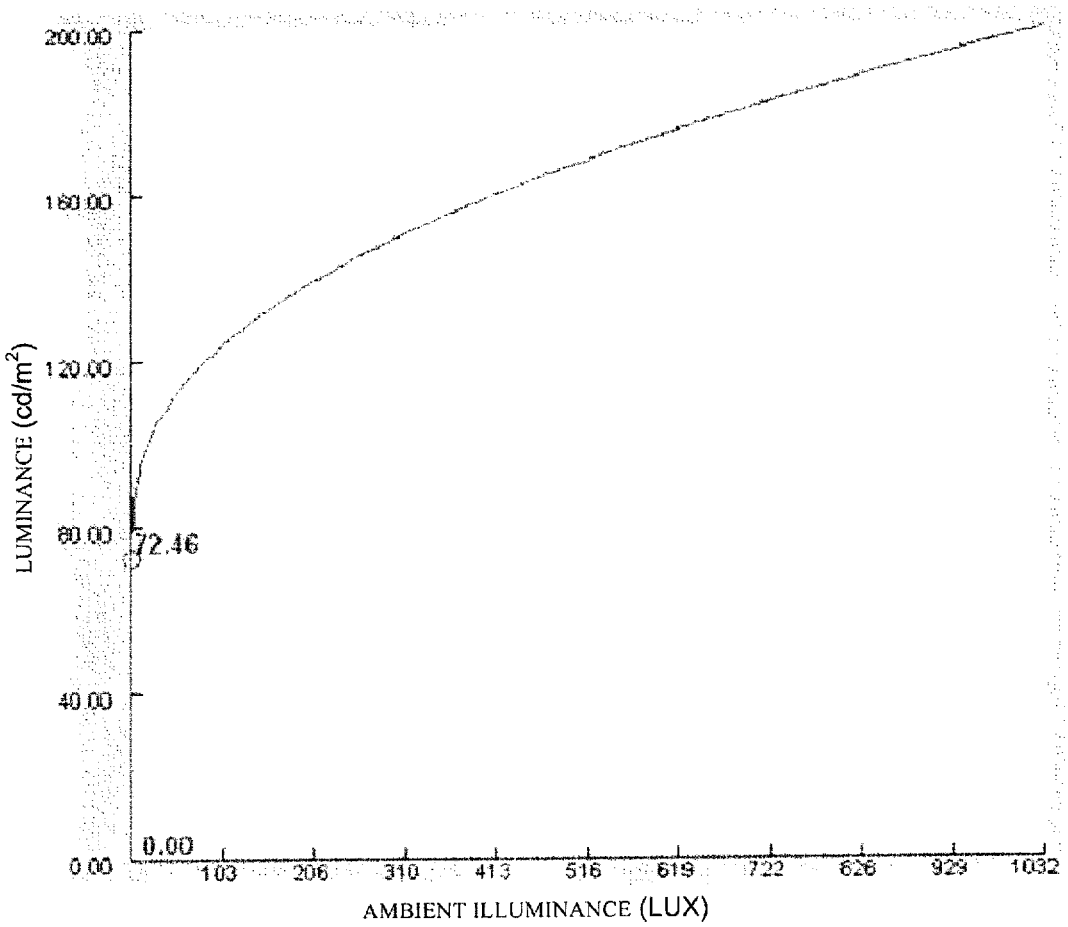
FIG. 3 is a graph illustrating the luminance of a display monitor with respect to ambient illuminance according to an aspect of the invention.

FIG. 3 illustrates an example of a graph produced using minimum perceivable brightness under a dark room condition and an office condition using Equation (3).

In FIG. 3, the horizontal axis indicates values of ambient illuminance sensed by the illuminance-sensing module 110, and the vertical axis indicates values of illuminance of a display monitor corresponding to the ambient illuminance.

In the case of an LCD, a display monitor has a linear relationship between luminance and driving power. Thus, driving power of a backlight unit corresponding to the ambient illuminance can be obtained by obtaining a ratio of the luminance value of the vertical axis to the maximum luminance. Even if the relationship between the luminance and the driving power of the display monitor is not linear, the power reduction can be easily obtained through power-to-luminance modeling of the display monitor.

When the power-to-luminance modeling is applied to an LCD, it can be used to control a backlight unit of the LCD. When the power-to-luminance modeling is applied to an OLED, which is one of representative self-emitting displays, it enables low-power driving responsive to ambient illuminance in a condition where a mobile device is utilized by proposing standards for dimming brightness of each pixel depending on illuminance.

While the minimum-perceivable-brightness-determination module 130 performs an operation on a display monitor luminance, that is, determines a user's minimum perceivable brightness using the Expression (3), it may store luminance information regarding ambient illuminance in a look-up table (LUT), thereby reducing a quantity of operations and increasing the efficiency of algorithms.

Figure 4:
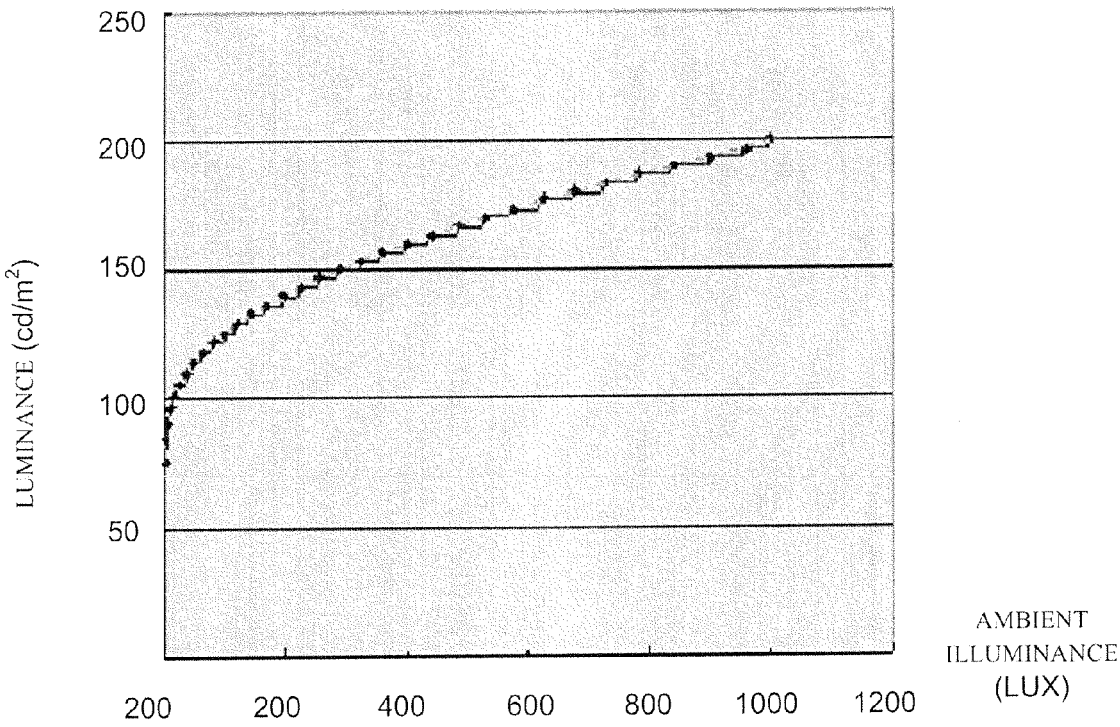
FIG. 4 illustrates a look-up table according to an aspect of the invention.

There are a variety of methods of forming the LUT. In the invention, intervals of ambient illuminance are non-linearly divided to be applied differently between a low illumination condition requiring elaborate adjustment and a high illumination condition sensing little change in brightness, as shown in FIG. 4, and results thereof are stored as shown in Table 1.

TABLE 1

| Ambient Illuminance (lux) | Brightness (cd/m$^2$) |
|---|---|
| 0 | 72 |
| 8 | 94 |
| ... | ... |
| 48 | 112 |
| ... | ... |
| 1008 | 200 |
| 1016 | 200 |

Once the minimum perceivable brightness is determined in such a manner, the driving-power-level-determination module 120 determines a driving power level corresponding to the determined minimum perceivable brightness in operation S230. To this end, as shown in Table 2, backlight unit luminance values corresponding to the minimum perceivable brightness and driving power level corresponding to the luminance are pre-stored in the form of a look-up table, and the driving-power-level-determination module 120 may determine driving power levels (%) responsive to the luminance.

TABLE 2

| Brightness (cd/m$^2$) | Driving Power Level(%) |
|---|---|
| 72 | 36 |
| 94 | 47 |
| ... | ... |
| 108 | 54 |
| 112 | 56 |
| ... | ... |
| 200 | 100 |

For example, referring to Tables 1 and 2, when the ambient illuminance is 48 lux, the display monitor luminance is 112 cd/m$^2$ and the maximum luminance is 200 cd/m$^2$, the driving power level is 56%. Accordingly, 44% (=100−56) power reduction can be achieved. While FIG. 1 shows that the driving-power-level-determination module 120 and the minimum-perceivable-brightness-determination module 130 are separate from each other, they can function as a single module, and the results shown in Tables 1 and 2 may be stored into an integrated table allowing a driving power level corresponding to ambient illuminance to be determined.

The driving module 140 provides a light source for displaying an image according to the determined driving power level in operation S240. The display module 150 displays the image using the provided light source in operation S250.

In the case of real-time controlling the power level of the driving module 140 using Equation (3), the display monitor brightness varies on a real-time basis according to illuminance inputs.

However, if a user uses a portable mobile device with an illuminance sensor, values of ambient illuminance sensed vary at any time depending on carrying angle and delicate movement. Accordingly, an undesirable flickering phenomenon may occur in the display monitor.

Therefore, it is necessary to control the flickering phenomenon by appropriately extending the range of illuminance change and the illuminance variation over time.

Figure 5:
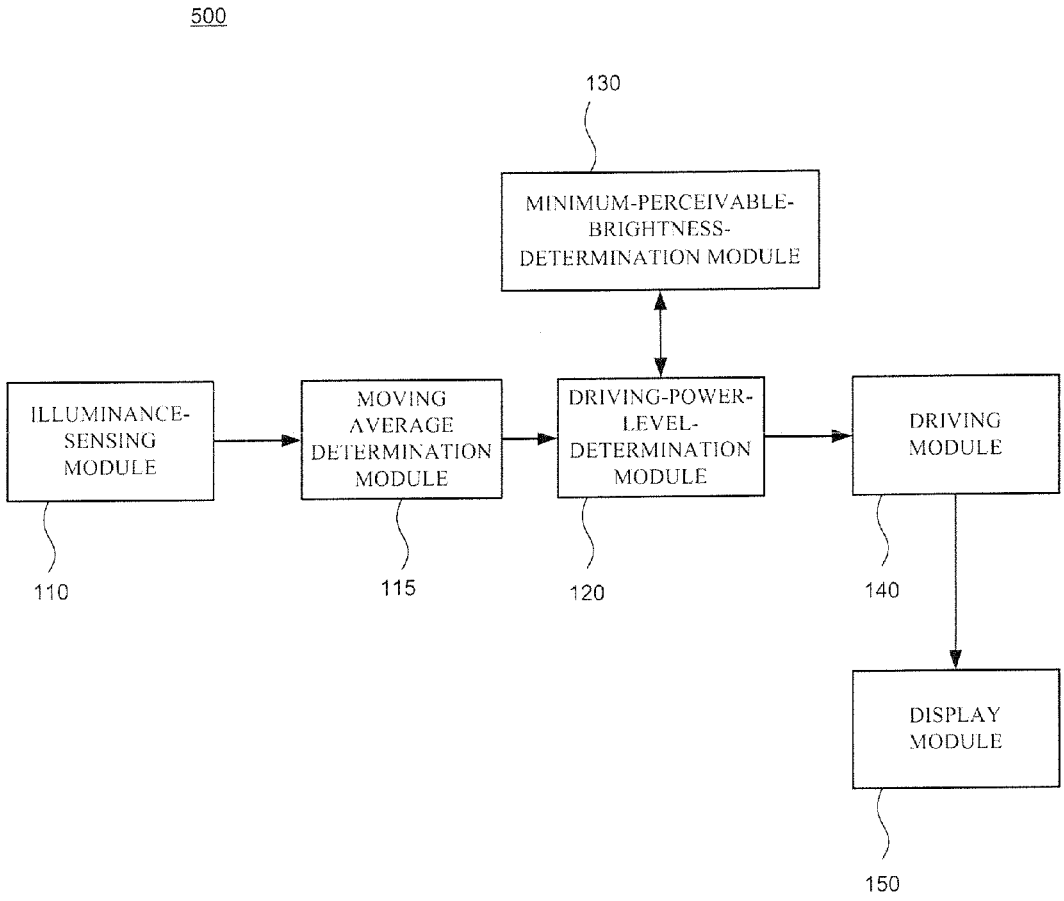
FIG. 5 is a block diagram of a low-power driving apparatus according to another aspect of the invention.

To control occurrence of the flickering phenomenon, as shown in FIG. 5, the moving average determination module 115 is provided to determine a moving average of illuminance values sensed by the illuminance-sensing module 110 and sampled at appropriate time intervals. Based on values resulting from the moving average determination, the minimum perceivable brightness allowed by a user on the display monitor can be determined using Equation (3) or a corresponding look-up table.

The other modules shown in FIG. 5 may be substantially the same as those shown in FIG. 1.

In addition, the value of the minimum perceivable brightness determined by the minimum-perceivable-brightness-determination module 130 may be subjected to a moving average determination to prevent additional flickering. To perform this purpose, the minimum-perceivable-brightness-determination module 130 or the driving-power-level-determination module 120 may perform a moving average determination.

As described above, on the one hand, power consumption can be reduced by determining a user's minimum perceivable brightness and adjusting a power level based on the determined user's minimum perceivable brightness. Power consumption can be further reduced using characteristics of input images. A low-power driving apparatus for achieving such a function is shown in FIG. 6.

Figure 6:
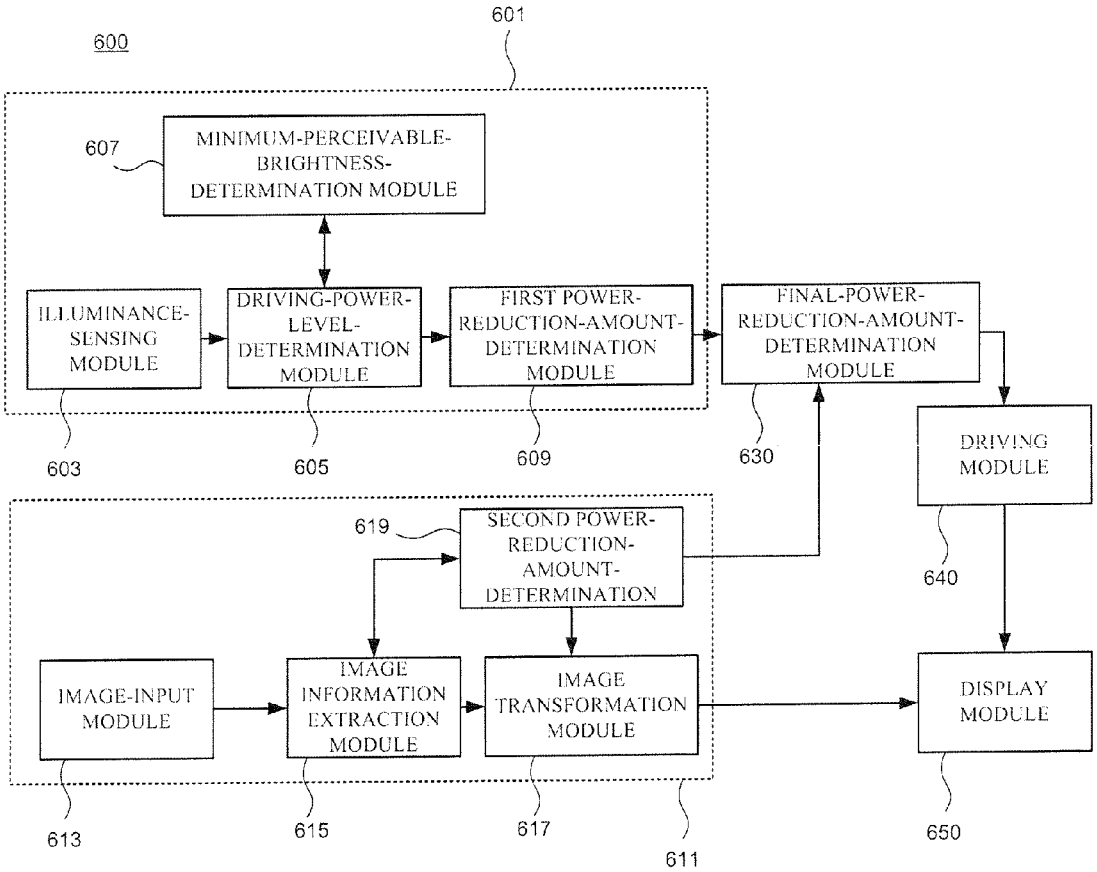
FIG. 6 is a block diagram of a low-power driving apparatus according to still another aspect of the invention.

Referring to FIG. 6, a low-power driving apparatus 600 according to still another aspect of the invention includes a first adjusting means 601 adjusting driving power according to ambient illuminance, and second adjusting means 611 adjusting driving power by adjusting image signal values based on image information regarding input images. In addition, the low-power driving apparatus 600 includes a final-power-reduction-amount-determination module 630, a driving module 640, and a display module 650. The driving module 640 and the display module 650 correspond to the driving module 140 and the display module 150 shown in FIG. 1, respectively.

In addition, the first adjusting means 601 includes an illuminance-sensing module 603, a driving-power-level-determination module 605, a minimum-perceivable-brightness-determination module 607, and a first power-reduction-amount-determination module 609. Here, the illuminance-sensing module 603, the driving-power-level-determination module 605 and the minimum-perceivable-brightness-determination module 607 correspond to the illuminance-sensing module 110, the driving-power-level-determination module 120 and the minimum-perceivable-brightness-determination module 130 shown in FIG. 1, respectively.

The first power-reduction-amount-determination module 609 determines a value of $\alpha$ ($0<\alpha<1$) corresponding to a ratio of the consumption power to the maximum power based on the driving power level determined by the driving-power-level-determination module 605.

The second adjusting means 611 includes an image-input module 613, an image information-sampling module 615, an image conversion module 617, and a second power-reduction-amount-determination module 610.

The image-input module 613 receives an image to supply the same to the image information-sampling module 615.

The image information-sampling module 615 samples image information of the received image and identifies image characteristics based on the sampled image information.

The image conversion module 617 converts the image input based on the identified characteristics and outputs the same to the display module 650.

The second power-reduction-amount-determination module 610 determines a value of $\beta$($0<\beta<1$) corresponding to a ratio of the power consumed to the maximum power based on the image characteristics identified by the image information-sampling module 615.

The final-power-reduction-amount-determination module 630 obtains a ratio $\alpha\beta$ of finally consumed driving power to the maximum power based on the $\alpha$ value determined by the first power-reduction-amount-determination module 609 and the $\beta$ value determined by the second power-reduction-amount-determination module 610 to then calculate a final power reduction ($1-\alpha\beta$). Accordingly, the driving module 640 reduces the driving power by an amount of $1-\alpha\beta$ to then provide a light source corresponding to the reduction amount to the display module 650.

Hereinafter, a method of implementing low-power driving using the image information will be described in detail.

First, the image information-sampling module 615 classifies input images into a predetermined number of image categories according to a luminance distribution of the input images. In more detail, the input images are classified into the predetermined number of image categories having the most similar characteristics to luminance histogram characteristics of the input images among image categories having different characteristics.

Here, the image categories mean models representing luminance distribution characteristics of various images, and types and numbers of image categories may be previously defined.

In order to generate a luminance histogram for a luminance distribution of the input images, it is necessary to obtain luminance values of the respective pixels of the input images. In an embodiment, in order to obtain the luminance values, the image information-sampling module 615 may use the NTSC (National Television Systems Committee) standard formula as represented by Equation (4):

$$Y=0.288R+0.576G+0.114B \tag{4}$$

where R, G and B indicate red, green and blue component values of target pixels whose luminance values are to be calculated, and Y indicates a luminance value of target pixels.

Equation (4) can be used when a color representing an input image is based on the RGB color space. If the color representing an input image is based on another color space, other method can be used to obtain a luminance value. In addition, since the invention is not limited to the method of obtaining the luminance value, even if the input image is based on the RGB color space, a method of obtaining the luminance value other than the NTSC standard formula may be used. If the input image is based on the luminance value containing color space, the process of the obtaining the luminance value may be skipped.

Figure 7:
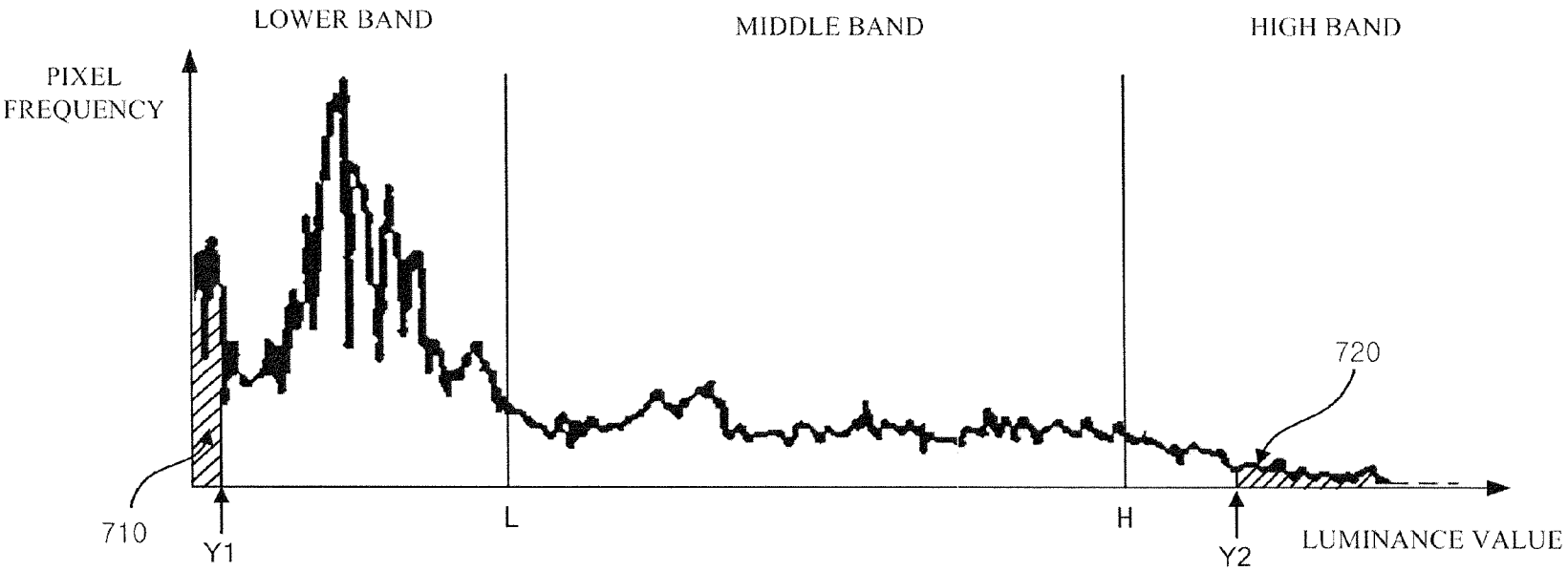
FIG. 7 is a diagram illustrating an exemplary luminance histogram of an arbitrary input image according to an aspect of the invention.

FIG. 7 is a diagram illustrating an exemplary luminance histogram of an arbitrary input image according to an aspect of the invention, in which the horizontal axis indicates the luminance value of the luminance histogram. For example, if an input image is an 8-bit image, the luminance value may have a value ranging from 0 to 255. Meanwhile, the vertical axis of the luminance histogram indicates pixel occurrence corresponding to each luminance value. Here, the pixel occurrence corresponds to a number of pixels having each luminance value in the input image.

If the luminance histogram for the input image is generated, the image information-sampling module 615 samples characteristics of the generated luminance histogram.

The characteristics of the luminance histogram are parameters that can be used to determine an image category to which an input image belongs. Multiple characteristics may be sampled from a luminance histogram. Which parameter to use as the characteristic of the luminance histogram may be determined when designing the low-power driving apparatus 600.

The parameters representing characteristics of a luminance histogram according to an aspect of the invention will be described with reference to FIG. 7.

As shown in FIG. 7, luminance ranges can be divided into a low band, a middle band, and a high band. Here, the luminance ranges mean a number of tones indicated by a pixel. For example, each pixel constituting an 8-bit image may have a luminance value in the range of 0-255, so that the 8-bit image luminance may range from 0 to 255.

A boundary between the respective bands may be set at a position at which characteristics of a luminance histogram can be represented most through a preliminary experiment.

For example, a boundary (L) between a low band and a middle band may be set at 25% lower than the luminance ranges (for an 8-bit image, 63 in luminance value). A boundary (H) between a middle band and a high band may be set 25% higher than the luminance ranges (for an 8-bit image, 191 in luminance value).

Examples of the parameter representing the characteristics of the luminance histogram include HighSUM, LowSUM, MiddleSUM, Mean, ZeroBin, Dynamic Range ("DR"), and the like.

"HighSUM" denotes a number of pixels included in a high band, "LowSUM" denotes a number of pixels included in a low band, and "MiddleSUM" denotes a number of pixels included in a middle band. "Mean" denotes a mean value of luminance values of all pixels constituting an input image (to be referred to as a mea luminance value, hereinafter).

"DR" denotes a dynamic range of the luminance value in the luminance histogram, and can be defined as Max-Min. Here, Max is a luminance value corresponding to a case where the sum of occurrences of the respective luminance values in the luminance histogram in an ascending order becomes 1% of the overall area of the luminance histogram. Min is a luminance value corresponding to a case where the sum of occurrences of the respective luminance values in the luminance histogram in a descending order becomes 1% of the overall area of the luminance histogram.

In the luminance histogram shown in FIG. 7, for example, if an area of a first area 710 is 1% of the overall luminance histogram area, Max equals Y1, and if an area of a second area 720 is 1% of the overall luminance histogram area, Min equals Y2. In this case, DR of the luminance histogram may be Y1-Y2.

"ZeroBin" denotes a number of pixels each having a luminance value smaller than a reference value in the luminance range, the reference value being set to 10% of the mea luminance value of the respective luminance values belonging to the middle band.

In such a manner, luminance histogram characteristics are analyzed and an image category having the most similar characteristics to those of the input image is selected. A luminance histogram which can represent the characteristics of the image category according to an aspect of the invention (to be referred to as a representative histogram, hereinafter) is shown in FIG. 8.

The luminance histogram characteristics of each image category will now be described with reference to FIG. 8. That is, an image category A represents more pixels belonging to a middle band and less pixels belonging to high and low bands. An image category B represents more pixels belonging to a high band. An image category C represents more pixels belonging to a low band. An image category D represents high contrast images whose pixels are mostly distributed in a high band and a low band. An image category E represents an image whose pixels are uniformly distributed throughout the whole bands. Finally, an image category F represents an image having luminance values discretely distributed, such as an image generated by graphical work.

Figure 8:
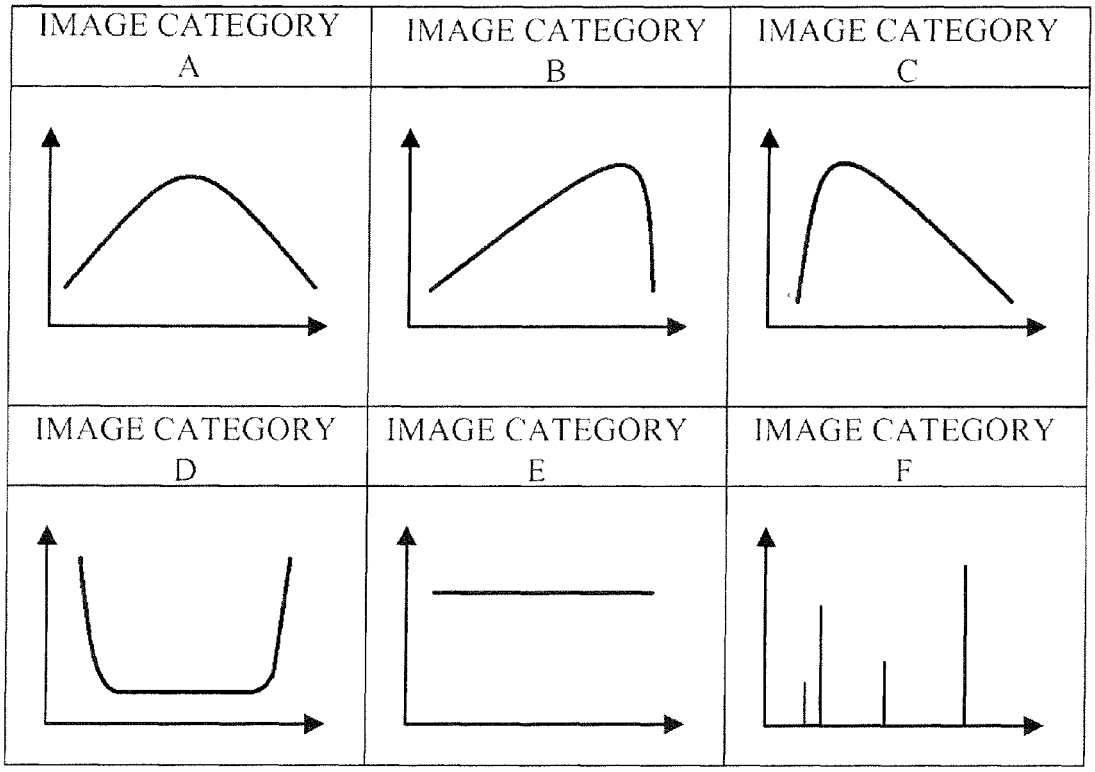
FIG. 8 is a representative luminance histogram for characteristics of each image category according to an aspect of the invention.

The representative luminance histogram for characteristics of each image category shown in FIG. 8 is provided only as an example, and an image category having different luminance histogram characteristics may be used.

When characteristics of the luminance histogram used to classify an input image include HighSUM, LowSUM, MiddleSUM, Mean, ZeroBin, Dynamic Range ("DR"), and the like, and image categories have luminance characteristics shown in FIG. 8, the image information-sampling module 615 classifies image categories for selection through comparison between characteristic values of each luminance histogram and particular constants.

Once an image category for the input image is selected in this way, the luminance of input image is adjusted according to a power mode and the image category to which the input image belongs. Here, the power mode indicates an extent of power consumed by the driving module 640.

For example, a normal power mode indicates that a display device uses a maximum power level, a low-power mode indicates a display device reduced power consumption to a predetermined extent. The low-power mode may further be divided into multiple low-power modes: a first low-power mode in the case where the power reduction is 30%, and a second low-power mode in the case where the power reduction is 60%, for example.

The image conversion module 617 may use a tone-mapping function (TMF) corresponding to an image category to which the input image belongs for effective image reproduction in a low-power mode. The TMF is a function indicating an optimized pattern for adjusting the luminance of an image belonging to each image category in a low-power mode and provides an output luminance value corresponding to an input luminance value. The TMF may be preset in the image conversion module 617 through a preliminary experiment.

Figure 9:
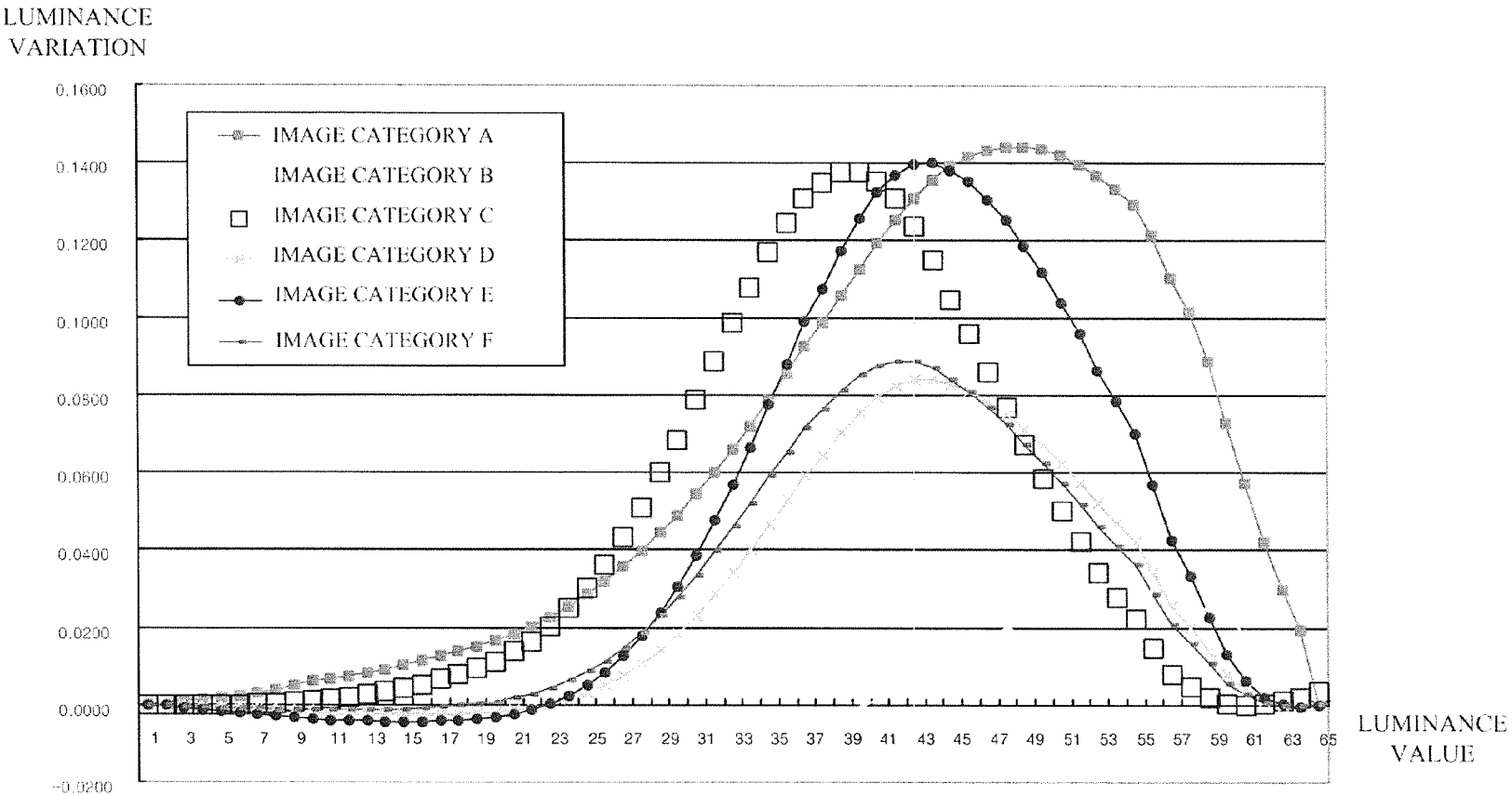
FIG. 9 is a graphical representation illustrating luminance variations using a tone-mapping function (TMF) according to an aspect of the invention.

FIG. 9 is a graphical representation illustrating luminance variations using the tone-mapping function (TMF) according to an aspect of the invention. Referring to FIG. 9, curves for luminance variations correspond to 6 image categories shown in FIG. 8. In FIG. 9, the horizontal axis indicates the input luminance value. In the embodiment, the input luminance value is in the range of 0-63 assuming that the input image is a 6-bit image. In addition, the vertical axis in FIG. 9 indicates the luminance variation corresponding to the input luminance value.

For example, the luminance of an input image may be varied using the graphical representation shown in FIG. 9 as follows. That is to say, in the case where the input image belongs to the image category E, since a luminance increase of pixels having a luminance value of 43 is 0.14, the luminance value of the corresponding pixels is calculated as 43+(43*0.14)≈49.

The luminance can be adjusted by fixed gain adjustment and variable gain adjustment, which will now be described in detail.

In the former method, that is, the method of using a fixed gain value, a luminance value of an input image is adjusted using a fixed gain value determined by a power reduction and a TMF corresponding to an image category to which the input image belongs. The luminance value adjusted by the fixed gain value can be expressed by Equation (5):

$$Y_{TMF_out}=Y_{in}+(\Delta Y_{TMF}\times G_{TMF}) \quad (5)$$

where $Y_{TMF_out}$ is an output luminance value for achieving an image with low-power driving, $Y_{in}$ is a luminance value, and $\Delta Y_{TMF}$ is a luminance increase based on TMF corresponding to an image category to which the input image belongs, i.e., the vertical axis of FIG. 9. In addition, $G_{TMF}$ is a gain value corresponding to the power reduction and the same value for all pixels constituting an input image. The value of $G_{TMF}$ may vary according to the power reduction. For example, the higher the power reduction, the lower the brightness of a light source of a display device (e.g., a backlight of a liquid crystal display (LCD). Accordingly, $G_{TMF}$ may be set to a value that gradually increases as the power reduction increases, thereby increasing the image luminance. An appropriate fixed gain value corresponding to the power reduction may be preset through a preliminary experiment. Alternatively, the fixed gain value may be determined by the second power-reduction-amount-determination module 619.

In the latter method, that is, in the method using a variable gain value, a luminance value of an input image is adjusted using a variable gain value determined by a position in the image of the respective pixels and a TMF corresponding to an image category to which the input image belongs. The luminance value adjusted by the variable gain value can be expressed by Equation (6):

$$Y_{TMF_out}=Y_{in}+(\Delta Y_{TMF}\times\alpha_{gain}(x,y)) \quad (6)$$

where $Y_{TMF_out}$, $Y_{in}$ and $\Delta Y_{TMF}$ are the same as defined in Equation (5). In Equation (6), x and y indicate coordinates of pixels within the image currently being processed (to be referred to as a target pixel, hereinafter), and $\alpha_{gain}(x,y)$ is a variable gain value which varies according to the special position of the target pixel within the image. The variable gain value may be determined by the second power-reduction-amount-determination module 619.

Preferably, the luminance value and the input luminance value are maintained at the same value by setting the variable gain value to 0 at a central area of the input image while the luminance increase is increased by maximizing the variable gain value at a peripheral area of the input image. In other areas, i.e., areas between the central area and the peripheral area, the variable gain value is gradually increased toward the peripheral area, thereby preventing image distortion due to a sharp change in the image brightness.

In order to calculate the variable gain value satisfying such characteristics, a Degaussian function may be used in an aspect of the invention. First, a Gaussian function according to an aspect of the invention is expressed as:

$$g(x,y)=\frac{1}{2\pi\sigma^2}e^{-\frac{\frac{\left(x-\frac{width}{2}\right)^2}{A}+\frac{\left(y-\frac{height}{2}\right)^2}{B}}{2\sigma^2}} \quad (7)$$

where "width" and "height" are magnitudes of an input image, and A and B are constants for modifying the Gaussian function into an elliptical shape according to an aspect ratio of the input image.

From the Gaussian function of Equation (7), a normalized Gaussian function is expressed as:

$$f(x,y)=1-\frac{g(x,y)}{\max[g(x,y)]} \quad (8)$$

If the Degaussian function of Equation (8) is used, the variable gain value can be expressed as:

$$\alpha_{gain}(x,y)=MAX_{gain}\cdot f(x,y) \quad (9)$$

where $MAX_{gain}$ is the maximum gain value corresponding to an image category to which the input image belongs and may be preset to an appropriate value optimized to adjustment of the input image luminance through a preliminary experiment. FIG. 10 shows variable gain values allocated to the respective pixels constituting an input image according to an aspect of the invention, in which $MAX_{gain}$ is 4 and the magnitude of the input image is 15*20.

In FIG. 10, various blocks indicate the respective pixels constituting an input image 1000, and a digit in each block indicates a variable gain value allocated to each pixel. As shown in FIG. 10, the variable gain value 0 is allocated at the central area of the input image 1000, and the variable gain value 4, which is the maximum gain value, is allocated at the peripheral area of the input image 1000. The variable gain value allocated to each pixel gradually increases in the range of 0 and 4 from the central area to the peripheral area of the input image 1000.

An image information-extraction module (see 615 of FIG. 6) may control image luminance by a fixed gain or a variable gain according to a power mode and the image category to which the input image belongs. Information concerning the power mode may be acquired from an external module (not shown). For example, the information concerning the power mode may be acquired from a controller (not shown) for controlling power of a driving module (see 640 of FIG. 6).

Figure 11:
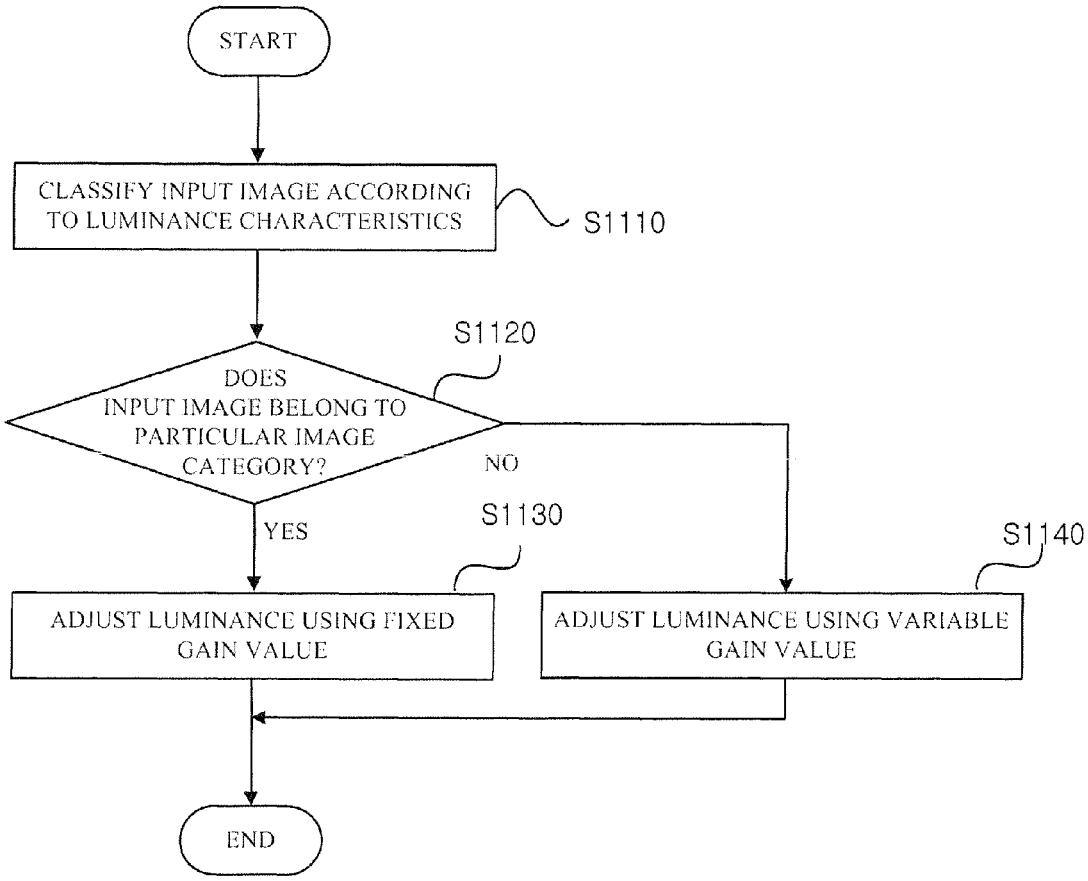
FIG. 11 is a flowchart illustrating an image processing process according to an aspect of the invention.

FIG. 11 is a flowchart illustrating an image processing process according to an aspect of the invention.

Upon receiving an input image, an image information-extraction module (see 615 of FIG. 6) classifies image categories of the input image based on luminance characteristics of the input image in operation S1110.

In operation S1120, the image information-sampling module 615 determines whether the image category to which the input image belongs is a particular image category or not. Here the particular image category may be image categories containing abnormal luminance information, such as image category D, image category F, and so on, or may be preset, as described above with reference to FIG. 8.

In operation S1120, if it is determined that the image category to which the input image belongs is a particular image category, an image conversion module (see 617 of FIG. 6) adjusts input image luminance using a fixed gain value determined by a second power-reduction-amount-determination module (see 619 of FIG. 6) in operation S1130.

However, in operation S1120, if it is not determined that the image category to which the input image belongs is a particular image category, the image conversion module 617 adjusts input image luminance using a variable gain value determined by the second power-reduction-amount-determination module 619 in operation S1140. The input image, the luminance of which is adjusted by the fixed gain value or the variable gain value, is displayed through a display module (see 650 FIG. 6). Further, the fixed gain value or the variable gain value is transferred to a final-power-reduction-amount-determination module (see 630 of FIG. 6) to be used to determine a final power reduction amount.

Meanwhile, the term "module," as used herein, refers to, for example, but is not limited to, a software or hardware component, such as a Field Programmable Gate Array (FPGA) or an Application Specific Integrated Circuit (ASIC), which performs certain tasks. A module may advantageously be configured to reside on the addressable storage medium and configured to execute on one or more processors. Thus, a module may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and modules may be combined into fewer components and modules or further separated into additional components and modules.

According to the invention, low-power driving of a mobile device in a restricted power supply condition can be implemented by dynamically controlling brightness of a display monitor of the mobile device based on the ambient condition and image content.

Although several embodiments of the invention have been shown and described, it would be appreciated by those skilled in the art that changes may be made in these embodiments without departing from the principles and spirit of the invention, the scope of which is defined in the claims and their equivalents.

What is claimed is:

1. A low-power driving apparatus comprising:

an illuminance-sensing module to sense illuminance;

a minimum-perceivable-brightness-determination module to determine a minimum perceivable brightness having non-linear characteristics corresponding to the sensed illuminance;

a driving-power-level-determination module to determine a power level based on the determined minimum perceivable brightness;

an image information module to classify an input image into one of image categories according to luminance histogram characteristics of the input image;

a power-reduction determination module to provide gain information to adjust the luminance of the input image according to a tone-mapping function and according to positions of pixels constituting the input image; and a driving module provided with a light source to display the input image according to the determined driving power level and the gain information provided from the power-reduction determination module.

2. The low-power driving apparatus of claim 1, wherein the determined minimum perceivable brightness is expressed as an exponential function of driving power with respect to the sensed illuminance.

3. The low-power driving apparatus of claim 1, wherein the determined minimum perceivable brightness is expressed as an exponential function of driving power having constants determined by experiments carried out at two different locations and the sensed illuminance as a base.

4. The low-power driving apparatus of claim 1, wherein the minimum-perceivable-brightness-determination module determines the minimum perceivable brightness by referring to a look-up table having an illuminance field and a minimum perceivable brightness field, the illuminance field being divided at non-linear intervals.

5. The low-power driving apparatus of claim 4, wherein the look-up table has different division intervals at low-illuminance areas and high-illuminance areas.

6. A low-power driving method comprising:

sensing illuminance;

determining a minimum perceivable brightness having non-linear characteristics corresponding to the sensed illuminance;

classifying an input image into one of image categories according to luminance histogram characteristics of the input image;

providing gain information for adjusting luminance of the input image according to a tone-mapping function and positions of pixels constituting the input image;

determining a power level based on the determined minimum perceivable brightness; and displaying the input image according to the determined driving power level and the gain information.

7. The low-power driving method of claim 6, wherein the determined minimum perceivable brightness is expressed as an exponential function of driving power with respect to the sensed illuminance.

8. The low-power driving method of claim 6, wherein the determined minimum perceivable brightness is expressed as an exponential function of driving power having constants determined by experiments carried out at two different locations and the sensed illuminance as a base.

9. The low-power driving method of claim 6, wherein the determining of the minimum perceivable brightness comprises determining the minimum perceivable brightness by referring to a look-up table having an illuminance field and a minimum perceivable brightness field, the illuminance field being divided at non-linear intervals.

10. The low-power driving method of claim 9, wherein the look-up table has different division intervals at low-illuminance areas and high-illuminance areas.

11. The low-power driving apparatus of claim 1, further comprising a moving average determination module to determine a moving average of illuminance sensed by the illuminance-sensing module.

12. The low-power driving apparatus of claim 11, wherein the minimum-perceivable brightness-determination module or the driving-power-level-determination module perform a moving average determination.

13. The low-power driving apparatus of claim 1, wherein the determined minimum perceivable brightness is expressed as an exponential function having the equation:

$$L_T=(C_1E_u^n+C_2)^{1/n}$$

wherein, $E_u$ denotes an ambient illuminance, $L_T$ denotes a luminance provided by the driving module according to the determined minimum perceivable brightness, and C1 and C2 are constants, wherein n, C1, and C2 are determined according to the determined minimum perceivable brightness, based on human visual perception characteristics.

14. The low-power driving apparatus of claim 13, wherein the constants C1 and C2 are further determined according to human visual perception characteristics under two different luminance conditions.

15. The low-power driving apparatus of claim 1, wherein the gain information to adjust the luminance of the input image according to a tone-mapping function is fixed, and the gain information to adjust the luminance of the input image according to positions of pixels constituting the input image is variable, and wherein the driving module provided with a light source displays the input image according to the determined driving power level and the fixed and variable gain information provided from the power-reduction determination module.

16. The low-power driving method of claim 6, wherein the sensing illuminance further comprises determining a moving average of illuminance.

17. The low-power driving method of claim 16, wherein the determining a minimum-perceivable brightness or the determining a power level further comprises determining a moving average.

18. The low-power driving method of claim 6, wherein the determined minimum perceivable brightness is expressed as an exponential function having the equation:

$$L_T=(C_1D_u^n+C_2)^{1/n}$$

wherein, $E_u$ denotes an ambient illuminance, $L_T$ denotes a luminance provided by the driving module according to the determined minimum perceivable brightness, and C1 and C2 are constants, wherein n, C1, and C2 are determined according to the determined minimum perceivable brightness, based on human visual perception characteristics.

19. The low-power driving method of claim 18, wherein the constants C1 and C2 are further determined according to human visual perception characteristics under two different luminance conditions.

20. The low-power driving method of claim 6, wherein the gain information for adjusting luminance of the input image according to a tone-mapping function is fixed, and the gain information for adjusting luminance of the input image according to positions of pixels constituting the input image is variable, and wherein the input image is displayed according to the determined driving power level and the fixed and variable gain information.

* * * * *